US009302486B2

(12) United States Patent
Nie

(10) Patent No.: US 9,302,486 B2
(45) Date of Patent: Apr. 5, 2016

(54) INK CARTRIDGE FOR INKJET PRINTER

(71) Applicant: ZHUHAI NINESTAR MANAGEMENT CO., LTD., Zhuhai (CN)

(72) Inventor: Bing Nie, Zhuhai (CN)

(73) Assignee: ZHUHAI NINESTAR MANAGEMENT CO., LTD., Zhuhai (CN)

( * ) Notice: Subject to any disclaimer, the term of this patent is extended or adjusted under 35 U.S.C. 154(b) by 35 days.

(21) Appl. No.: 14/309,800

(22) Filed: Jun. 19, 2014

(65) Prior Publication Data

US 2014/0300671 A1 Oct. 9, 2014

Related U.S. Application Data

(63) Continuation of application No. PCT/CN2012/087451, filed on Dec. 25, 2012.

(30) Foreign Application Priority Data

Dec. 27, 2011 (CN) ..... 2011 1 0445676

(51) Int. Cl.
*B41J 2/165* (2006.01)
*B41J 2/175* (2006.01)

(52) U.S. Cl.
CPC ..... *B41J 2/17543* (2013.01); *B41J 2/1752* (2013.01); *B41J 2/17513* (2013.01); *B41J 2/17546* (2013.01); *B41J 2/17553* (2013.01)

(58) Field of Classification Search
None
See application file for complete search history.

(56) References Cited

U.S. PATENT DOCUMENTS

| | | | | |
|---|---|---|---|---|
| 2002/0140750 | A1 | 10/2002 | Yoshiyama et al. | 347/7 |
| 2003/0011654 | A1 | 1/2003 | Asauchi | 347/19 |
| 2006/0244795 | A1 * | 11/2006 | Hayasaki et al. | 347/86 |
| 2009/0322835 | A1 * | 12/2009 | Kanbe et al. | 347/86 |
| 2012/0056957 | A1 * | 3/2012 | Xiao | 347/86 |

FOREIGN PATENT DOCUMENTS

| | | | |
|---|---|---|---|
| CN | 101468553 | A | 7/2009 |
| CN | 102001229 | A | 4/2011 |
| EP | 1 547 781 | A2 | 6/2005 |
| GB | 2 317 589 | A | 4/1998 |

OTHER PUBLICATIONS

International Search Report of corresponding PCT International Application No. PCT/CN2012/087451, dated Mar. 28, 2013.

* cited by examiner

*Primary Examiner* — Alejandro Valencia
(74) *Attorney, Agent, or Firm* — J.C. Patents

(57) ABSTRACT

The present invention relates to an ink cartridge for an inkjet printer, which comprises: an ink reservoir for storing ink, an ink outlet for supplying ink to the printer, and an installation detection component which is coordinated with the printer to detect whether the ink cartridge is successfully installed. The installation detection component includes a controller, a connecting circuit and a light-emitting portion connected with the controller through the connecting circuit. The controller is configured to control the light-emitting portion to emit light which will be received by sensors of the printer to determine whether the installation is successful, and controls the light-emitting portion automatically. The ink cartridge for the inkjet printer provided by the present invention solves the technical problem that the installation of the traditional ink cartridge must undergo strict actual inspection of a printer installation program.

16 Claims, 18 Drawing Sheets

INK CARTRIDGE FOR INKJET PRINTER

CROSS-REFERENCE TO RELATED APPLICATIONS

This application is a continuation of the International Application No. PCT/CN2012/087451 filed on Dec. 25, 2012, which claims the priority benefits of China Patent Application No. 201110445676.8 filed on Dec. 27, 2011. The contents of those prior applications are hereby incorporated by reference in their entireties.

FIELD OF THE TECHNOLOGY

The present invention relates to an ink cartridge for supplying ink to an inkjet printer.

BACKGROUND

Inkjet printing is more and more favored by users due to the advantage of colorful printing. In order to guarantee the printing effect, higher requirement is put forward on an ink cartridge for supplying ink to a printer, and particularly relevant parameters of the ink cartridge, for instance, the ink type, the ink level, the manufacturer of the ink cartridge and other information, must be researched. The research of the relevant parameters of the ink cartridge seems very important.

In the prior art, the commonly used ink cartridge information detection mode is to dispose an integrated circuit and a piezoelectric sensor, an optical prism or the like on an ink cartridge and preset information such as the manufacturer of the ink cartridge, the ink color, the ink composition, the ink level and the production date of ink in the integrated circuit; and when the ink cartridge is installed to the printer, the printer can continue printing only when the information in the ink cartridge is in full compliance with required information on the printer. Although the mode can accurately detect the parameter information of the ink cartridge, the cost of the integrated circuit is very high. Moreover, once the ink cartridge is used, internal parameters of the ink cartridge can be modified and cannot be reused again. Therefore, the printing cost can be increased and electronic waste can be produced.

For instance, the Chinese patent Publication No. CN102001229 provides an ink cartridge, which comprises: a first signal blocking portion, a second signal blocking portion and a third signal blocking portion, wherein the first signal blocking portion is configured to prevent a first signal from running through the first signal blocking portion or change a path of the first signal when the first signal blocking portion receives the first signal; the second signal blocking portion is configured to prevent a second signal from running through the second signal blocking portion or change a path of the second signal when the second signal blocking portion receives the second signal; the third signal blocking portion is configured to prevent a third signal from running through the third signal blocking portion or change a path of the third signal when the third signal blocking portion receives the third signal; and a printer prompts correct ink cartridge installation only when light complies with the predetermined blocking sequence.

Moreover, the patent Application No. 2009100015237 discloses a liquid container capable of being detachably mounted to a recording apparatus. The recording apparatus includes: a plurality of liquid container mounting portions, a plurality of apparatus electrical contacts, a transmitter for transmitting signal through a shared wire, a photoreceptor and a discriminator for determining the matching correctness when the mounting portion of the liquid container is mounted. The liquid container comprises: a plurality of container electrical contacts electrically connected with the apparatus electrical contacts, a liquid accommodating portion for accommodating liquid, an information storage portion for storing determination information, a light-emitting portion for emitting light to the photoreceptor, and a controller for controlling the light-emitting portion to emit light to the discriminator according to information supplied by the transmitter and the determination information, so as to determine the matching correctness.

However, the ink cartridge also has a problem. As the controller is configured to control the light-emitting portion to emit light to the discriminator according to the information supplied by the transmitter and the determination information and is controlled by the printer, the installation of the ink cartridge must undergo strict actual inspection of a printer installation program; due to different installation proficiencies of users, different users have different installation speeds in the installation process; and once the users install the ink cartridge too fast and the printer has no enough time to respond to the on-off state of the above optical signals, particularly when the second signal blocking portion and the third signal blocking portion do not block the optical signals, if the printer cannot identify the information, the case that a correct ink cartridge cannot be identified by the printer can be caused.

In addition, the ink cartridge also has a problem. A remaining ink amount detection unit in the ink cartridge prompts via a buoy disposed in an ink reservoir. When the buoy moves up and down along with the movement of an ink surface, the buoy may be affected by bubbles on the ink surface, and hence the sensitivity of the vertical movement is insufficient, and consequently the detection result can be affected.

SUMMARY

The present invention provides an ink cartridge for an inkjet printer, which solves the technical problem that the installation of the traditional ink cartridge must undergo strict actual inspection of a printer installation program.

In order to solve the technical problem, the present invention adopts the technical proposal that:

The present invention relates to an ink cartridge for an inkjet printer, which comprises: an ink reservoir for storing ink, an ink outlet for supplying ink to the printer, and an installation detection component coordinated with the printer to detect whether the ink cartridge is successfully installed; the installation detection component includes a controller, a connecting circuit and a light-emitting portion connected with the controller through the connecting circuit; and the controller is configured to control the light-emitting portion to emit light received by sensors of the printer to determine whether the installation is successful, wherein the controller controls the light-emitting portion automatically.

The controller is a trigger switch which slides in the installation process of the ink cartridge to control the light emission of the light-emitting portion.

The controller is an automatic control module which automatically controls the light emission of the light-emitting portion.

The installation detection component further includes a battery which supplies power to the controller and the light-emitting portion through the connecting circuit.

The installation detection component further includes a first signal blocking portion disposed at the front upper end of the ink cartridge and a second signal blocking portion disposed at the front central end of the ink cartridge; the second signal blocking portion is disposed on a light shield plate of the ink cartridge; and the light-emitting portion is also disposed on the light shield plate.

The ink cartridge for the inkjet printer further comprises a reset member which is coordinated with the trigger switch in such a way that the trigger switch is restored to the natural state when the ink cartridge is not installed.

The automatic control module is configured to control the light emission of the light-emitting portion according to the detection requirement of successful installation in the installation detection program of the printer.

The light emitted by the light-emitting portion is visible light or infrared light.

One end of the trigger switch is disposed on the front of the ink cartridge so that the trigger switch can abut against an inner wall of the printer in the installation process of the ink cartridge.

One end of the trigger switch is disposed at the rear of the ink cartridge so that the trigger switch can be controlled by manual operation in the installation process of the ink cartridge.

The ink cartridge for the inkjet printer further comprises an remaining ink amount detection component; the remaining ink amount detection component includes a control mechanism relevant to the remaining ink amount in the ink reservoir and an alarm mechanism connected with the control mechanism and configured to generate an alarm signal when the remaining ink amount in the ink reservoir is less than a default value; and at least one side wall of the ink reservoir is formed by a deformable film, wherein the control mechanism is a circuit switch; the on-off state of the circuit switch is controlled by the moving distance of the deformable film; and whether the alarm mechanism generates the alarm signal or not is controlled by the on-off state of the circuit switch.

The circuit switch is a slide switch which is switched on or off by sliding driven by the movement of the deformable film.

The circuit switch is a contact switch which is switched on or off by contact separation or touch driven by the movement of the deformable film.

The alarm mechanism is a light-emitting member or a speaker.

The present invention also provides an ink cartridge for an inkjet printer, which solves the technical problem of large occupied space of a circuit board in the traditional ink cartridge for an inkjet printer.

In order to solve the technical problem, the present invention adopts the technical proposal that:

The present invention relates to an ink cartridge for an inkjet printer, which comprises: an ink reservoir for storing ink, an ink outlet for supplying ink to the printer, and an installation detection component coordinated with the printer to detect whether the ink cartridge is successfully installed; and the installation detection component includes a controller, a connecting circuit and a light-emitting portion connected with the controller through the connecting circuit, wherein the connecting circuit is formed by a flexible printed circuit board (FPC) provided with at least one branch; and one end of the branch may rotate freely.

The FPC is provided with two branches; the trigger switch is disposed on a first branch and includes two contacts; and the circuit switch is disposed on a second branch and includes two contacts.

The trigger switch is disposed at a free end of the first branch; and in the manufacturing process, the free end rotates around the FPC so that a flexible circuit is T-shaped.

The circuit switch is disposed at a free end of the second branch so that the circuit switch may rotate along with the movement of another end of the second branch.

The present invention also provides an ink cartridge for an inkjet printer, which solves the technical problem that the traditional ink cartridge for the inkjet printer can only be passively matched with optical signals on the printer.

In order to solve the technical problem, the present invention adopts the technical proposal that:

The present invention relates to an ink cartridge for an inkjet printer, which comprises: an ink reservoir for storing ink, an ink outlet for supplying ink to the printer, and an installation detection component coordinated with the printer to detect whether the ink cartridge is successfully installed; and the installation detection component includes a trigger switch, a connecting circuit and a light-emitting portion, wherein the trigger switch includes a slider and contacts 1 and 2 formed on the connecting circuit; the slider is provided with an end portion capable of switching on the contacts 1 and 2 of the switch; in the installation process of the ink cartridge, the slider may move between two positions; when the slider is disposed at the first position or the second position, the contacts 1 and 2 are in the off state; and when the slider is disposed at a connecting position between the first position and the second position, the switch is in the on state to control the light emission of the light-emitting portion.

The contacts 1 and 2 are respectively two end points on the first contact of the connecting circuit.

The ink cartridge for the inkjet printer further comprises a reset member which is coordinated with the trigger switch in such a way that the trigger switch is restored to the natural state when the ink cartridge is not installed.

The present invention also provides an ink cartridge for an inkjet printer, which solves the technical problem that the traditional ink cartridge for the inkjet printer cannot be accurately detected by the printer.

In order to solve the technical proposal, the present invention adopts the technical proposal that:

The present invention relates to an ink cartridge for an inkjet printer, which comprises: an ink reservoir for storing ink, an ink outlet for supplying ink to the printer, and an installation detection component coordinated with the printer to detect whether the ink cartridge is successfully installed, wherein the installation detection component includes a controller, a connecting circuit and a light-emitting portion connected with the controller through the connecting circuit; the connecting circuit is provided with a trigger switch and a circuit switch; the trigger switch is coordinated with the controller to complete the installation detection of the ink cartridge; and the circuit switch is configured to complete the remaining ink amount detection.

The connecting circuit is formed by an FPC.

The controller is a trigger switch which slides in the installation process of the ink cartridge to control the light emission of the light-emitting portion.

The controller is an automatic control module which automatically controls the on-off state of the trigger switch and controls the light emission of the light-emitting portion.

The installation detection component further includes a battery which supplies power to the controller and the light-emitting portion through the connecting circuit.

The light emission of the light-emitting portion is controlled by the control of the on-off state of the trigger switch in the installation process of the ink cartridge.

At least one side wall of the ink reservoir is formed by a flexible film; and the on-off state of the circuit switch is controlled by the movement of the flexible film.

The flexible film is coordinated with the FPC through a lever; one end of the lever is adhered to the flexible film and the other end of the lever is provided with a conductive sheet; the connecting circuit is provided with two switch-off contacts; and the circuit switch is formed by the conductive sheet and the two switch-off contacts.

The ink cartridge for the inkjet printer further comprises a conductive sheet disposed on the FPC; one end of the FPC is adhered to the flexible film; the connecting circuit is provided with two switch-off contacts; and the circuit switch is formed by the conductive sheet and the two switch-off contacts.

By adoption of the technical proposals, as the controller automatically controls the light-emitting portion and is not controlled by a control program of the printer, the installation of the ink cartridge does not need to undergo strict actual inspection of the printer installation program and the installation detection can be achieved by simulation or the determination of a simple installation program. Therefore, the technical problem that the installation of the traditional ink cartridge must undergo strict actual inspection of the printer installation program can be solved. In addition, the problem that the correct ink cartridge cannot be identified due to too fast installation speed of the users can be solved.

As the connecting circuit is formed by the FPC which is provided with at least one branch and one end of the branch may rotate freely, the space occupied by the connecting circuit can be greatly reduced by overturning, and hence the technical problem of large occupied space of the circuit board in the traditional ink cartridge for the inkjet printer can be solved.

REFERENCE NUMERALS OF THE ACCOMPANYING DRAWINGS

| | | |
|---|---|---|
| 1-Ink Cartridge; | 2-Housing; | 3-Protrusion; |
| 4-Ink Reservoir; | 5/51/52/53/54-Hollow Cylinder; | 6-Ink Outlet; |
| 7-Slider; | 71-Sliding Portion; | 72-End Portion; |
| 73-Connecting Portion; | 8-Spring; | 9-Connecting Circuit; |
| 91a/91b-First Contact; | 92a/92b-Second Contact; | 10/101/102-Positioning Hole; |
| 11-Helical Spring; | 12-Lever; | 121/122-End Portion; |
| 123/124-Connecting Portion | 125-Rotating Portion; | 13-Top Cover; |
| 14-Cylinder; | 15/16-Lug Boss; | 151-Recess; |
| 17-Barrier Plate; | 18-Guide Rail; | 19-Connecting Circuit Mounting Portion; |
| 20/21-Positioning Column; | 22-Light Shield Plate; | 23-Inner Wall; |
| 24-Handle; | 241-Handle Portion; | 242/243-End Portion; |
| 25-Flexible Film; | 26-Light-emitting Portion; | 26b-Light-emitting Member; |

-continued

| | | |
|---|---|---|
| 27-Power Source; | 28a/28b-Electrode Contact; | 29-Conductive Sheet; |
| 200-Ink Cartridge Installation portion; | 201-First Sensor; | 202-Second Sensor; |
| 203-Ink Supply Needle; | 204-Abutting Portion; | 205-Frame; |
| 206-Cover; | 202a/202b-Light Transmitting/receiving Portion. | |

DETAILED DESCRIPTION

Detailed description will be given below to the embodiments of the present invention with reference to the accompanying drawings for better understanding of the present invention by those skilled in the art. All the variations made on the basis of the technical proposals without creative labor shall fall within the scope of protection of the present invention.

Embodiment 1

Figure 1:
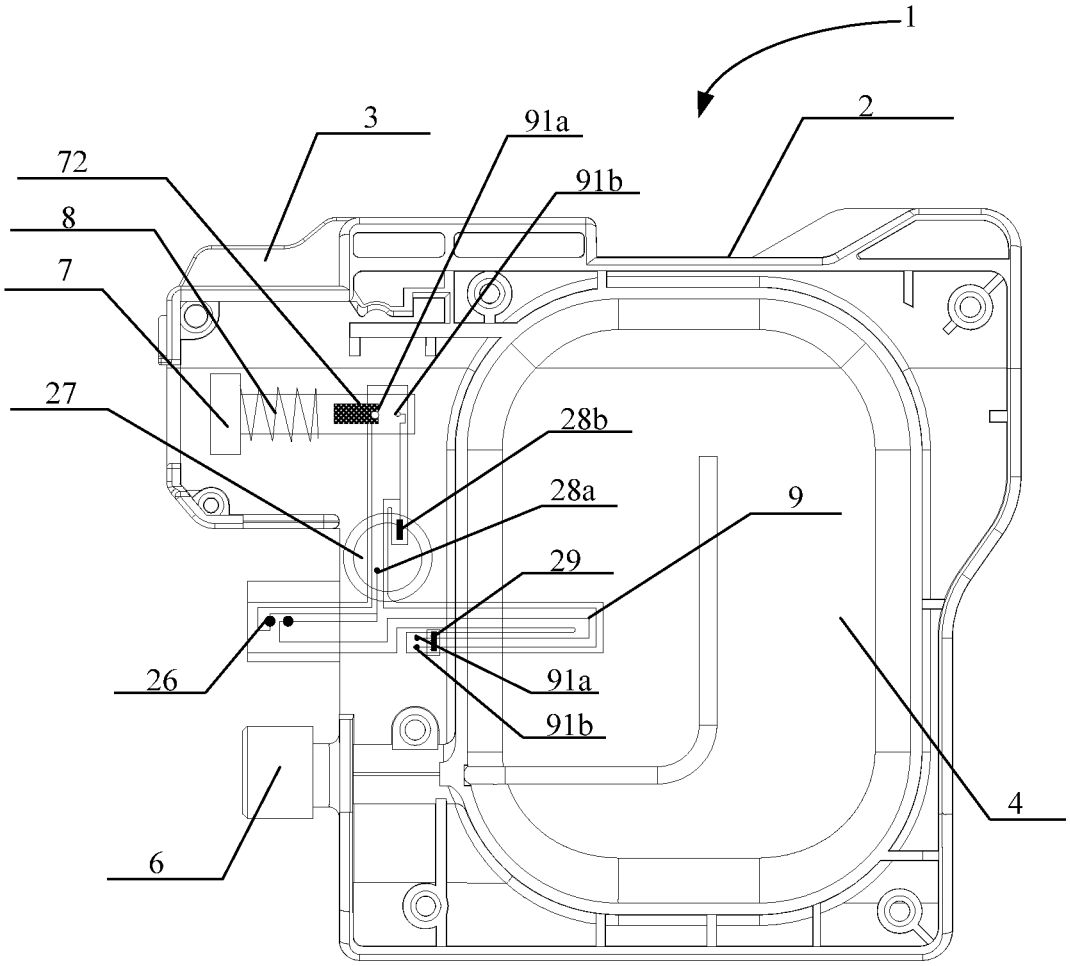
FIG. 1 is a schematic structural view of an ink cartridge provided by an embodiment 1 of the present invention.

As illustrated in FIG. 1, the present invention relates to an ink cartridge 1 for an inkjet printer, which comprises: a housing 2, an ink reservoir 4 for storing ink, an ink outlet 6 for supplying ink to the printer, an installation detection component coordinated with the printer to detect whether the ink cartridge is successfully installed, and a remaining ink amount detection component. The installation detection component includes a first signal blocking portion, namely a protrusion 3, disposed at the front upper end of the ink cartridge, a second signal blocking portion disposed at the front central end of the ink cartridge and disposed on a light shield plate 22, a controller, a connecting circuit 9, a light-emitting portion 26 connected with the controller through the connecting circuit 9, a reset member, namely a spring 8, and a power source 27 for supplying power to the controller and the light-emitting portion 26 through the connecting circuit 9; the controller is configured to control the light-emitting portion 26 to emit light received by sensors of the printer so as to determine whether the installation is successful and is a trigger switch for automatically controlling the light-emitting portion; the trigger switch is not controlled by a control program of the printer, and slides in the installation process of the ink cartridge to control the light emission of the light-emitting portion 26; the spring 8 is coordinated with the trigger switch in such a way that the trigger switch is restored to the natural state when the ink cartridge is not installed; the light-emitting portion 26 is disposed on the light shield plate 22; one end of the trigger switch is disposed on the front of the ink cartridge so that the trigger switch can abut against an inner wall of the printer in the installation process of the ink cartridge; and light emitted by the light-emitting portion 26 is visible light or infrared light. The remaining ink amount detection component includes a control mechanism relevant to the remaining ink amount in the ink reservoir and an alarm mechanism connected with the control mechanism and configured to generate an alarm signal when the remaining ink amount in the ink reservoir is less than a default value; at least one side wall of the ink reservoir 4 is formed by a deformable film 25; the control mechanism is a circuit switch; the on-off state of the circuit switch is controlled by the moving distance of the deformable film; whether the alarm mechanism generates the alarm signal is controlled by the on-off state of the circuit switch; and the circuit switch is a slide switch which is switched on or off by sliding driven by the movement of the deformable film. Of course, the circuit switch may be a contact switch which is switched on or off by the contact separation or touch driven by the movement of the deformable film. The alarm mechanism is a light-emitting member 26*b*, and of course, may also be a speaker.

The ink reservoir 4 is one part of the housing 2 and includes at least one opening; the opening is sealed by a deformable flexible film; the flexible film may be deformed along with the variation of the ink level in the ink reservoir; the ink outlet 6 is a printhead for supplying the ink in the ink reservoir 4 to the printer; a sliding portion of the trigger switch includes a slider 7 and an end portion 72 disposed on the slider 7 and made of conductive materials; the spring 8 is coordinated with the slider 7 and applies a biasing force to the slider in the direction opposite to the ink cartridge installation direction; of course, the end portion 72 made of the conductive materials may be set to be a member separated from the slider 7, for instance, a conductive sheet clamped on or adhered to the slider 7 or a conductive spring wire directly assembled to the slider 7; the connecting circuit 9 is provided with a pair of first contacts 91*a* and 91*b*, a pair of second contacts 92*a* and 92*b* and a pair of electrode contacts 28*a* and 28*b*; the trigger switch in the circuit is formed by the pair of first contacts 91*a* and 91*b* and the sliding portion of the trigger switch; the circuit switch is formed by the pair of second contacts 92*a* and 92*b* and the conductive sheet 29 on the ink cartridge; the light-emitting portion 26 is connected with the connecting circuit 9 and may generate a preset optical signal under the control of the connecting circuit 9; the optical signal may be emitted at a predetermined moment for predetermined duration with predetermined wavelength, frequency and brightness, and may be visible light and may also be invisible infrared light; the power source 27 is configured to supply power to the connecting circuit 9 through the electrode contacts 28*a* and 28*b* so that the light-emitting portion 26 can emit light; and the power source may be formed by a dry battery or an accumulator and other power sources with small size.

Figure 2:
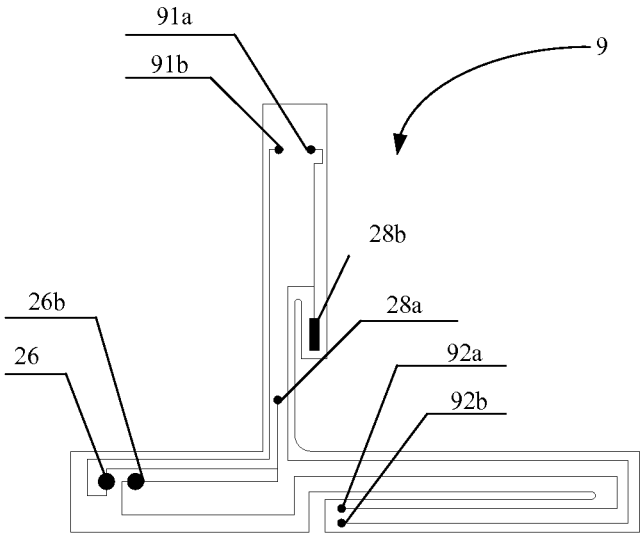
FIG. 2 is a schematic structural view of a connecting circuit provided by the embodiment 1 of the present invention.
Figure 5:
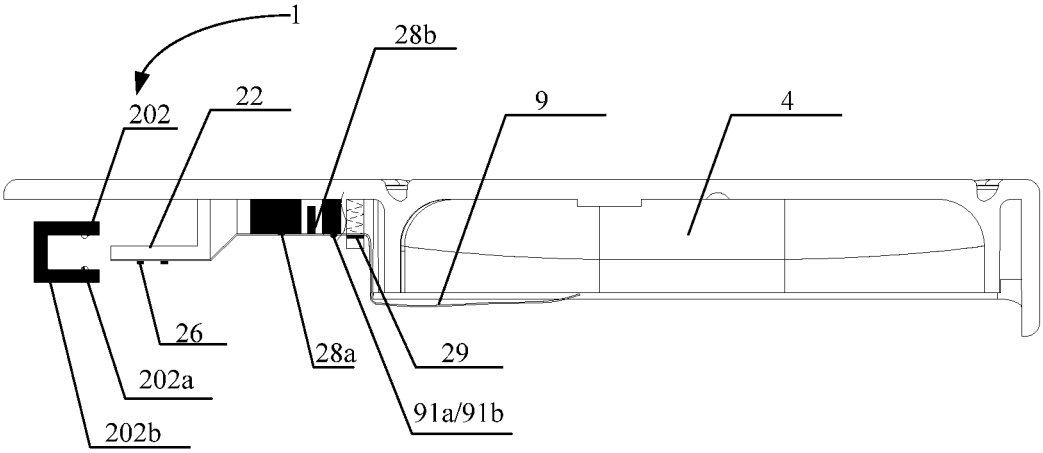
FIG. 5 is a side view of the ink cartridge provided by the embodiment 1 of the present invention.

FIG. 2 is a schematic structural view of the connecting circuit provided by the embodiment 1 of the present invention, and FIG. 5 is a side view of the ink cartridge provided by the embodiment 1 of the present invention. As illustrated in FIGS. 2 and 5, the connecting circuit 9 is formed by an FPC; the electrode contact 28*b* is set to be capable of moving freely in the thickness direction of the ink cartridge; the electrode contacts 28*a* and 28*b* are respectively disposed on both sides of the battery and connected with positive and negative electrodes of the battery; preferably, the light-emitting portion 26 and the light-emitting member 26*b* are disposed on the FPC; light emitted by the light-emitting portion 26 may be received by the sensors in the printer in the detection process; when the remaining ink amount is reduced to the default value, light emitted by the light-emitting member 26*b* may be received by the sensors in the printer; of course, in the case of enough high luminous brightness, the light-emitting portion or the light-emitting member may be arranged alternatively and shared; and at least one part of the connecting circuit 9 is disposed on the flexible film of the ink reservoir 4. A portion, provided with the circuit switch, of the FPC, is set to be that: when the ink level is reduced, the second contacts 92*a* and 92*b* move close to the conductive sheet 29 on the ink cartridge; when the remaining ink amount in the ink reservoir 4 is reduced to the default value, the conductive sheet 29 switches on the second contacts 92*a* and 92*b* of the circuit switch, and hence the light-emitting member 26*b* may emit light. The second contacts 92*a* and 92*b* and the electrode contacts 28*a* and 28*b* of the FPC except the first contacts 91*a* and 91*b* are conductive parts, and the other part is insulated; preferably, a spring is disposed under a portion between the FPC provided with the circuit switch and a flexible circuit portion adhered to the flexible film, so that the flexible circuit can make tight contact with the conductive sheet 29, and hence the detection accuracy can be improved; the first contacts 91*a* and 91*b*, the second contacts 92*a* and 92*b* and the electrode contacts 28*a* and 28*b* are set to be small protrusions, and the end portion 72 and the conductive sheet 29 are provided with a recess respectively; or the contacts are set to be recesses, and the end portion and the conductive sheet are provided with a protrusion respectively, which more facilitates the switch-on of the trigger switch and the circuit switch and hence avoids error detection. Of course, the circuit switch may also adopt the normally closed (NC) mode. That is to say, in the natural state, the circuit switch is closed; and the light-emitting member 26*b* does not emit light at this point and only emits light when the circuit switch is switched off. For instance, the circuit switch is set to be the NC state; the switching state is only varied when the ink runs out; and the light-emitting member 26*b* emits light along with the variation of the switching state. Therefore, the light-emitting member 26*b* acts as a signal display unit, and a member involved when the flexible circuit detects the ink-out situation acts as a signal generating unit.

Of course, the controller of the ink cartridge may also be an automatic control module which is not controlled by the control program of the printer. The automatic control module may execute automatic control with a preset program in the storage device, e.g., the luminous moment, the luminous duration, the luminous frequency and the luminous intensity, and a preset trigger signal, e.g., the case that the ink cartridge abuts against the printer and the case that a switch capable of being manually adjusted, a label and the like are disposed on the outside of the ink cartridge.

Figure 3:
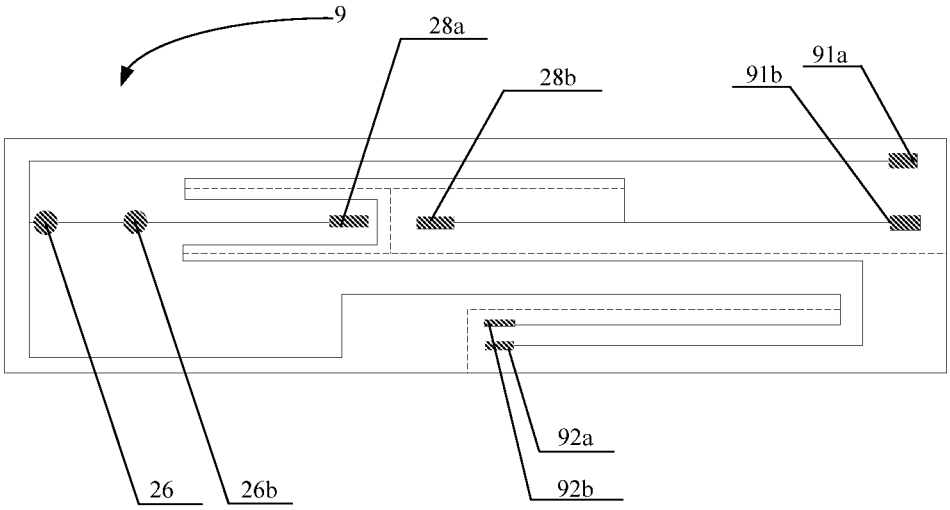
FIG. 3 is a preferred schematic structural view of the connecting circuit provided by the embodiment 1 of the present invention.
Figure 4:
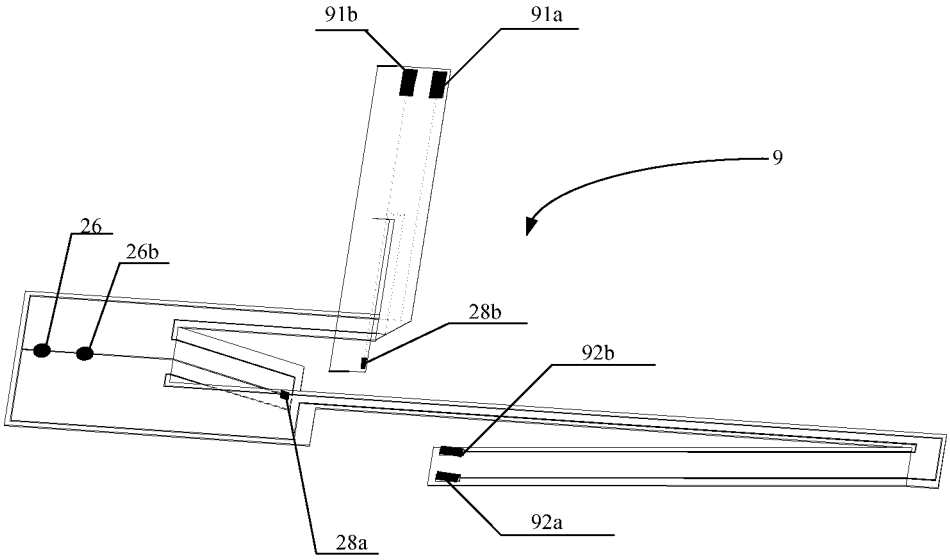
FIG. 4 is a folding diagram of the connecting circuit as shown in FIG. 3.

FIG. 3 is a preferred schematic structural view of the connecting circuit provided by the embodiment 1 of the present invention, and FIG. 4 is a folding diagram of the connecting circuit as shown in FIG. 3. In the production process, a central section of the FPC may be divided in such a way that one end of at least one part of the FPC is fixed on the FPC and the other end may move freely; and in the use process, at least one part is overturned to obtain a branch at a certain angle with the original circuit board. The FPC includes the first contacts 91*a* and 91*b*; the divided portion is a first branch; as the flexible circuit has good flexibility, a free end of the first branch, provided with the first contacts 91 and 91*b* (a contact 1 described below is the first contact 91*a* and a contact 2 described below is the second contact 91*b*) may rotate freely, which is more conducive to the assembly of the FPC; at least one part of the FPC, provided with the second contacts 92*a* and 92*b*, is set to be a second branch; one end of the second branch is connected with a main body of the FPC and the other end may rotate freely; at least one part of the branch is adhered to the flexible film on the surface of the ink reservoir 4; in this case, when the ink level in the ink reservoir 4 is reduced, the branch will be driven to move by the recess of the flexible film, and the second contacts 92*a* and 92*b* will be driven to move by the movement of the branch; and the remaining ink amount may be detected by the movement of the second contacts 92*a* and 92*b*. More specifically, the connecting circuit 9 as shown in FIG. 2 is set to be "T"-shaped. In this case, leftover materials will be produced in the production process, resulting in waste and increasing the production cost. Taking the above factors into account, in the preferred embodiment, the connecting circuit 9 is formed by the FPC; as the FPC has good flexibility and tends to be deformed, the connecting circuit 9 is directly set to be "linear"; the central section of the circuit board is divided from a dotted portion as shown in FIG. 3, and the part of the circuit board provided with the first contacts 91*a* and 91*b* is folded up; and hence the "linear" circuit board may be folded into the "T"-shaped circuit board as shown in FIG. 4 without affecting the performances of the connecting circuit 9. In this case, after processing, the power source 27, for instance, a button cell, can be more easily installed as the FPC tends to be deformed; the second contacts 92*a* and 92*b* may be more easily deformed due to the reason of division, but other parts of the FPC cannot be affected; and hence the detection result of the remaining ink amount can be guaranteed to be more accurate.

In addition, the power source on the ink cartridge may adopt a button cell; the button cell is directly clamped between the two contacts 28*a* and 28*b* on the FPC; at least one of the two contacts 28*a* and 28*b* may move freely relative to the FPC; and hence the battery can be more conveniently installed.

Figure 6:
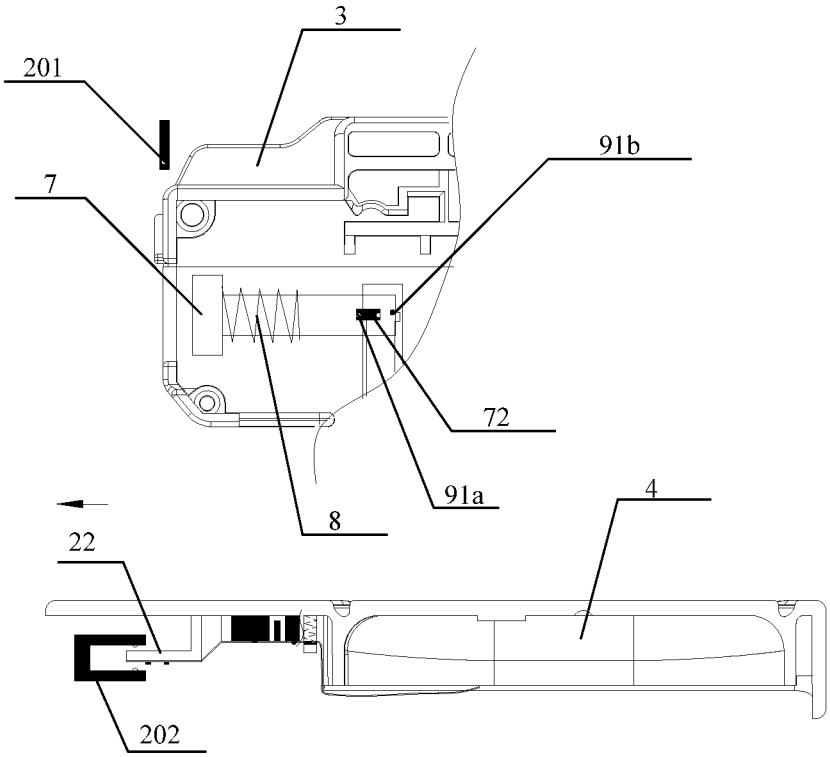
FIG. 6 is a schematic partial view of the ink cartridge provided by the embodiment 1 of the present invention when installed to the printer in the very beginning.
Figure 7:
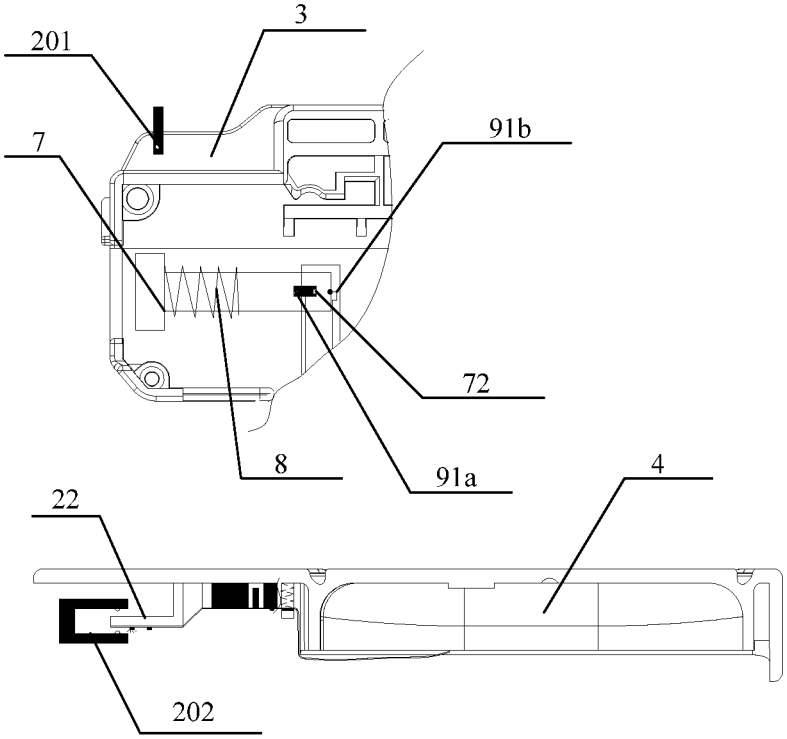
FIG. 7 is a schematic partial view of the ink cartridge provided by the embodiment 1 of the present invention when being installed to the printer and in the second state.
Figure 8:
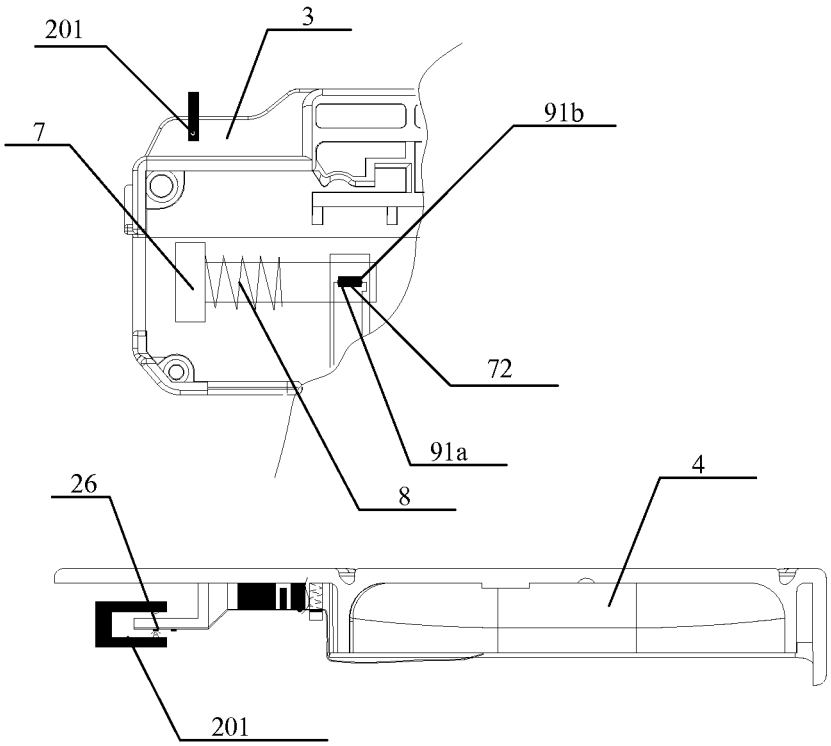
FIG. 8 is a schematic partial view of the ink cartridge provided by the embodiment 1 of the present invention when being installed to the printer and in the third state.
Figure 9:
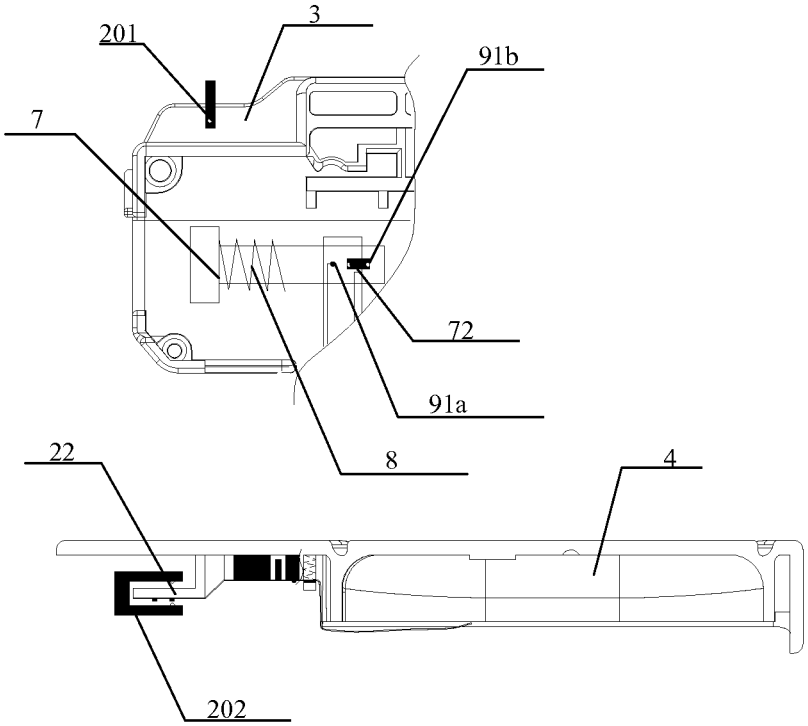
FIG. 9 is a schematic partial view of the ink cartridge provided by the embodiment 1 of the present invention when being installed to the printer and in the fourth state.

FIGS. 6 to 9 are schematic partial views illustrating the installation process of the ink cartridge. As illustrated in FIG. 6, in the installation process of the ink cartridge, the installation detection component of the ink cartridge 1 is formed by the light shield plate 22, the protrusion 3 and the light-emitting portion; the second signal blocking portion on the light shield plate 22 blocks an optical transmission path of a second sensor 202 in the printer at first; when the ink cartridge is in the second state, the protrusion 3 and the light shield plate 22 respectively block light from a first sensor 201 and the second sensor 202 in the printer; when the ink cartridge is in the third state, the slider 7 drives the end portion 72 to be connected with the contact 1, namely 91*a*, and the contact 2, namely 91*b*, on the first contact on the connecting circuit 9, through an abutting portion in the printer; and at this point, the trigger switch is switched on and the light emitted by the light-emitting portion 26 may be received by a light receiving portion 202*b* on the sensor 202. Finally, when the ink cartridge is in the fourth state, the ink cartridge is completely installed to the printer; the ink outlet 6 is communicated with an ink supply needle of the printer; at this point, the slider 7 on the ink cartridge 1 is pushed to a position, deviated from the trigger switch of the communicated connecting circuit, again; the light-emitting portion 26 does not emit light again; the protrusion 3 and the light shield plate 22 respectively block the light emitted by the light transmitting portions of the first sensor 201 and the second sensor 202; the light shield sequence may be identified by the first sensor 201 and the second sensor 202 and fed back to the printer; and whether the ink cartridge is correct may be identified according to the light shield sequence.

As for another type of ink cartridge, before the protrusion 3 blocks the light of the first sensor 201 in the printer, the slider 7 is pushed to the position deviated from the trigger switch of the communicated connecting circuit 9, and hence different sequences can be produced. In addition, the light-emitting portion 26 of the connecting circuit 9 may emit light at different initial moments for predetermined duration through the presetting, and hence more variety of information can be obtained.

Figure 10:
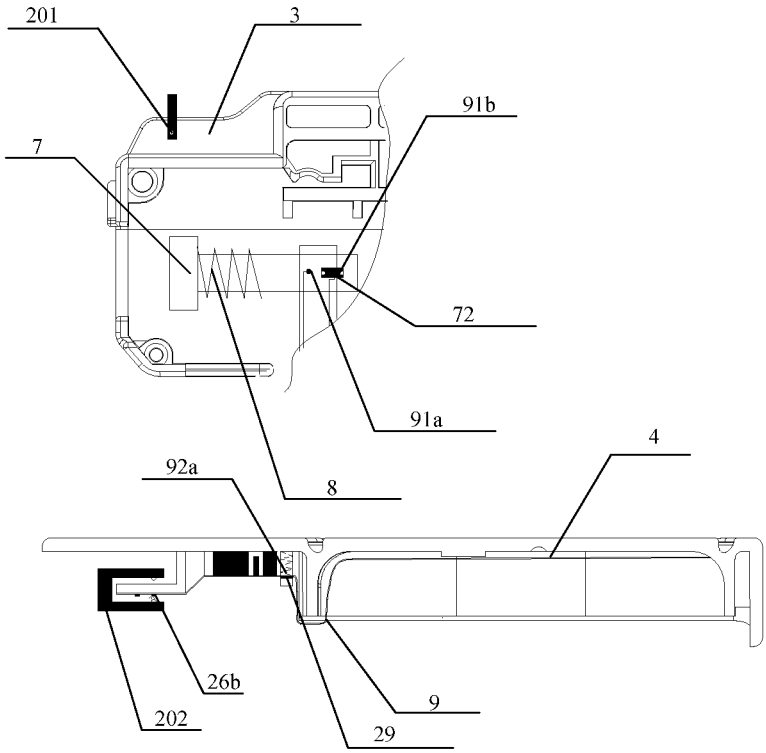
FIG. 10 is a schematic partial view of the ink cartridge provided by the embodiment 1 of the present invention when ink in an ink reservoir runs out.

FIG. 10 is a schematic partial view of the ink cartridge provided by the embodiment 1 of the present invention when the ink in the ink reservoir runs out. The remaining ink amount detection component of the ink cartridge 1 includes at least one part of the connecting circuit 9, the flexible film and the conductive sheet 29; when the ink in the ink reservoir 4 of the ink cartridge 1 is reduced to the default value, the connecting circuit 9 formed by the FPC is recessed towards the ink reservoir 4 along with the deformation of the flexible film on the surface of the ink reservoir 4, and hence the second contacts 92*a* and 92*b* are driven to move towards the conductive sheet 29; by the presetting, when the ink level in the ink reservoir 4 is reduced to the default value, the second contacts 92*a* and 92*b* are switched on by the conductive sheet 29, and hence the light-emitting member 26*b* can emit light which may be received by the light receiving portion 202*b* on the second sensor 202; and the printer prompts the user to replace the ink cartridge after receiving information fed back by the sensor.

Of course, the ink cartridge installation component and the remaining ink amount detection component may also be set to be independent components and directly assembled to the ink cartridge, which is more conducive to the production.

Embodiment 2

Figure 11:
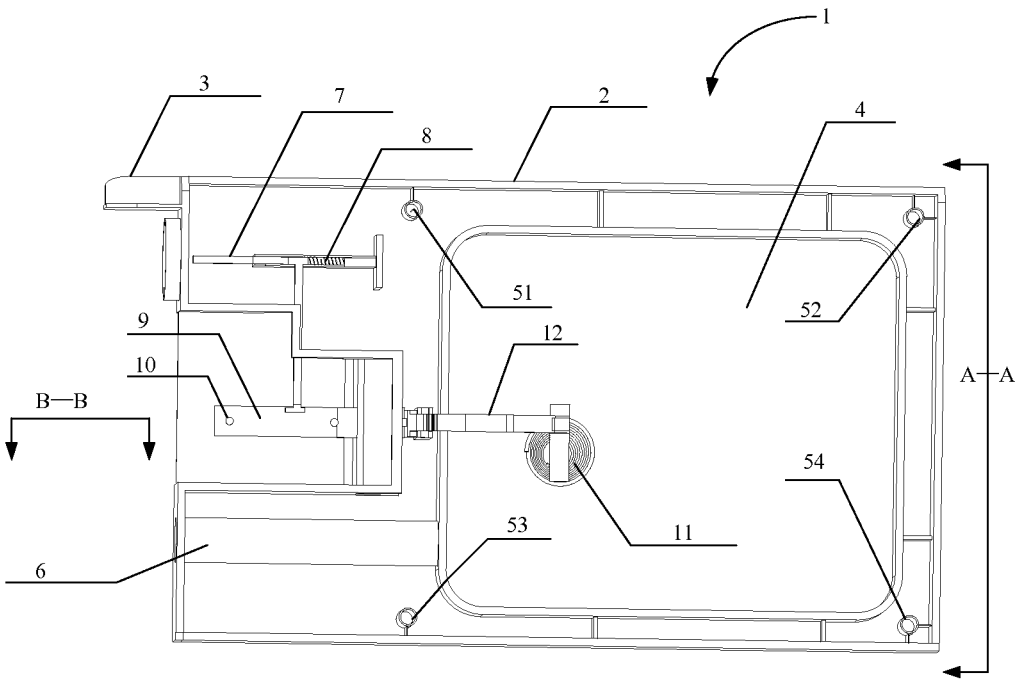
FIG. 11 is a schematic structural view of an ink cartridge provided by an embodiment 2 of the present invention.

FIG. 11 is a schematic structural view of an ink cartridge provided by the embodiment 2 of the present invention. As illustrated in FIG. 11, the present invention relates to an ink cartridge 1 for an inkjet printer, which comprises: a housing 2, an ink reservoir 4 for storing ink, an ink outlet 6 for supplying ink to the printer, hollow cylinders 5, a helical spring 11, a lever 12, a flexible film 25, a top cover 13, an installation detection component coordinated with the printer to detect whether the ink cartridge is successfully installed, and a remaining ink amount detection component. The installation detection component includes a first signal blocking portion, namely a protrusion 3, disposed at the front upper end of the ink cartridge, a second signal blocking portion disposed at the front central end of the ink cartridge and disposed on a light shield plate 22, a controller, a connecting circuit 9, a light-emitting portion connected with the controller through the connecting circuit 9, a reset member, namely a spring 8, and a power source 27 for supplying power to the controller and the light-emitting portion through the connecting circuit 9; the controller is configured to control the light-emitting portion to emit light received by sensors of the printer so as to determine whether the installation is successful; the controller herein is a trigger switch for automatically controlling the light-emitting portion; the trigger switch is not controlled by a control program of the printer, and slides in the installation process of the ink cartridge to control the light emission of the light-emitting portion; the spring 8 is coordinated with the trigger switch in such a way that the trigger switch is restored to the natural state when the ink cartridge is not installed; and the light-emitting portion is disposed on the light shield plate 22. One end of the trigger switch is disposed on the front of the ink cartridge so that the trigger switch can abut against an inner wall of the printer in the installation process of the ink cartridge. Of course, one end of the trigger switch may also be disposed at the rear of the ink cartridge so that the trigger switch can be controlled by manual operation in the installation process of the ink cartridge. The light emitted by the light-emitting portion is visible light or infrared light. The remaining ink amount detection component includes a control mechanism relevant to the remaining ink amount in the ink reservoir and an alarm mechanism connected with the control mechanism and configured to generate an alarm signal when the remaining ink amount in the ink reservoir is less than a default value; at least one side wall of the ink reservoir 4 is formed by a deformable film; the control mechanism is a circuit switch; the on-off state of the circuit switch is controlled by the moving distance of the deformable film; whether the alarm mechanism generates the alarm signal is controlled by the on-off state of the circuit switch; and the circuit switch is a slide switch which is switched on or off by sliding driven by the movement of the deformable film. Of course, the circuit switch may also be a contact switch which is switched on or off by contact separation or touch driven by the movement of the deformable film. The alarm mechanism is a light-emitting member, and of course, may also be speaker. In the embodiment, the light-emitting portion and the light-emitting member share a lamp.

Figure 12:
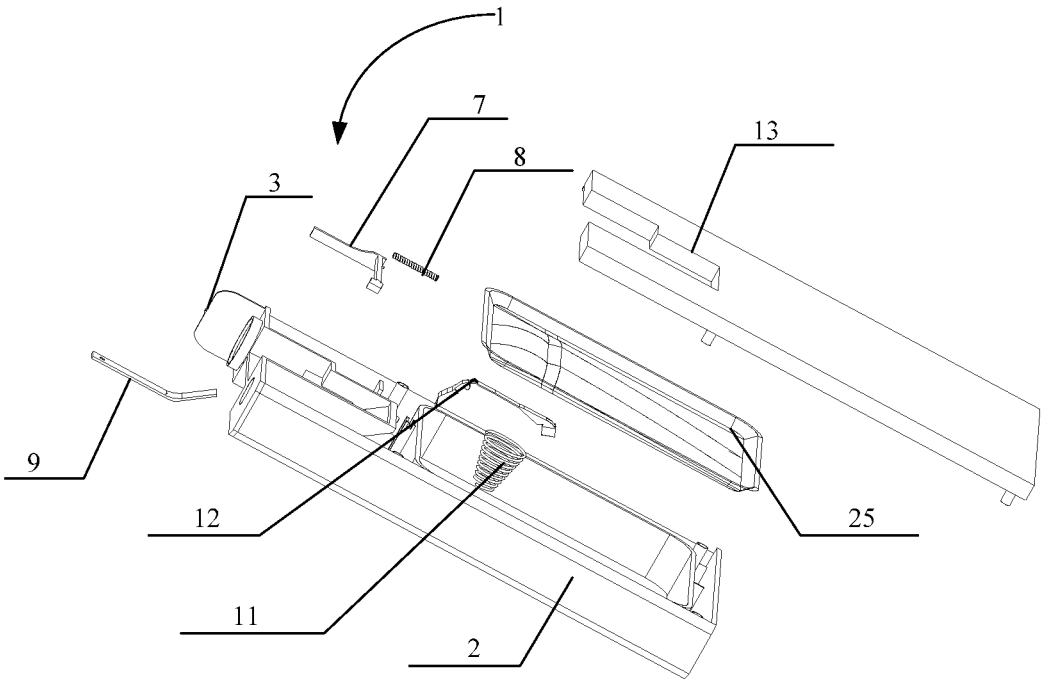
FIG. 12 is a schematic exploded view of the ink cartridge provided by embodiment 2 of the present invention.

FIG. 12 is a schematic exploded view of the ink cartridge provided by the embodiment 2 of the present invention. Four hollow cylinders 51, 52, 53 and 54 are coordinated with the top cover 13; the ink outlet 6 is configured to supply the ink in the ink reservoir 4 to the printer; the trigger switch includes a slider 7 which may move relative to a front end surface in the installation process of the ink cartridge 1; the spring 8 is coordinated with the trigger switch to push the slider 7 to a preset position when the ink cartridge is in the natural state and has the function of resetting the slider 7; the connecting circuit 9 may switch on the connecting circuit when the slider 7 slides to the preset position, and generate a preset optical signal, for instance, the connecting circuit can emit light with predetermined time, brightness, intensity and frequency; the light includes visible light and infrared light; the flexible film 25 is set to be one part of the ink reservoir 4; the ink reservoir 4 in the present invention may be formed by adopting the flexible film 25 to seal an opening of the housing 2; the helical spring 11 is disposed in the ink reservoir 4 and configured to support the flexible film 25 so that the flexible film 25 can be accurately lowered along with the reduction of the ink level in the ink reservoir 4; one end of the lever 12 is adhered to the flexible film 25 and the other end may switch on the connecting circuit 9, so that the connecting circuit 9 can emit light when the remaining ink amount in the ink reservoir 4 is reduced to the default value, and the printer prompts the user to replace the ink cartridge according to optical information fed back by the lamp of the connecting circuit; and the top cover 13 is coordinated with the hollow cylinders 5 on the housing, so that at least the slider 7, the lever 12 and the flexible film 25 will not be damaged by external collision.

Figure 13:
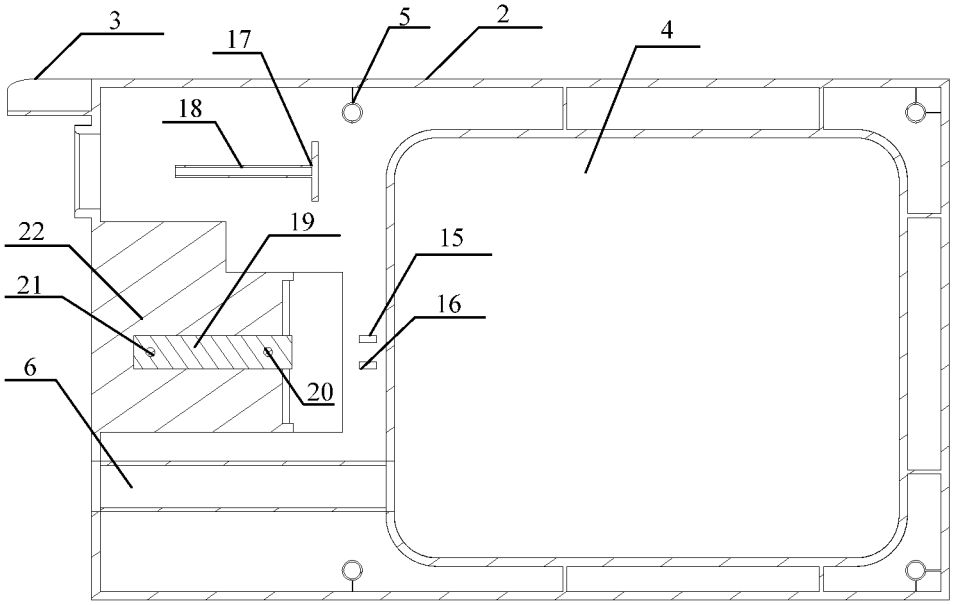
FIG. 13 is a sectional view of the ink cartridge as shown in FIG. 1 in the A-A direction.
Figure 14:
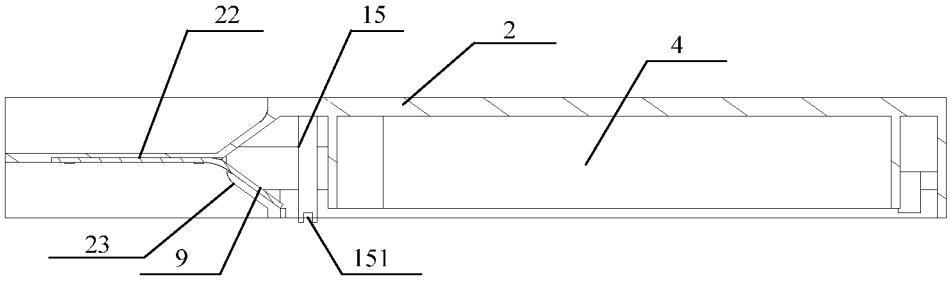
FIG. 14 is a sectional view of the ink cartridge as shown in FIG. 1 in the B-B direction.

The structure characteristics of the ink cartridge will be described in detail below with reference to FIGS. 11 to 14. FIG. 13 is a sectional view of the ink cartridge as shown in FIG. 11 in the A-A direction, and FIG. 14 is a sectional view of the ink cartridge as shown in FIG. 11 in the B-B direction. The housing 2 is provided with lug bosses 15 and 16, a recess 151, a barrier plate 17, a guide rail 18, a connecting circuit mounting portion 19, positioning columns 20 and 21 and an inner wall 23; and the light shield plate 22 is also disposed on the housing 2. The lug bosses 15 and 16 are extended along the direction perpendicular to the ink cartridge installation direction from the inner wall of the housing; the lug boss 15 is provided with the recess 151 which is coordinated with the lever 12 so that the lever 12 can rotate in the recess; the lug boss 16 is provided with same recess (not shown); the barrier plate 17 is disposed on a horizontal line with an abutting portion of the printer; one end of the spring 8 may be fixed on the barrier plate 17; the guide rail 18 is extended along the installation direction of the ink cartridge 1 from the barrier plate 17 so that the slider 7 can slide on the guide rail 18 along the installation direction of the ink cartridge 1; the light shield plate 22 is disposed at the front central end of the ink cartridge and may block or change an optical transmission path of sensors in the printer; a connecting circuit mounting portion 19 is disposed on the light shield plate 22 and provided with two positioning columns 20 and 21 which are coordinated with positioning holes on the circuiting circuit board so that the connecting circuit 9 can be stably installed on the housing 2; the inner wall 23 is connected with the light shield plate 22; at least one part of the connecting circuit 9 is disposed on the inner wall; and in the technical proposal, preferably, the inner wall 23 is configured to form an inclination angle with the light shield plate 22.

Figure 15:
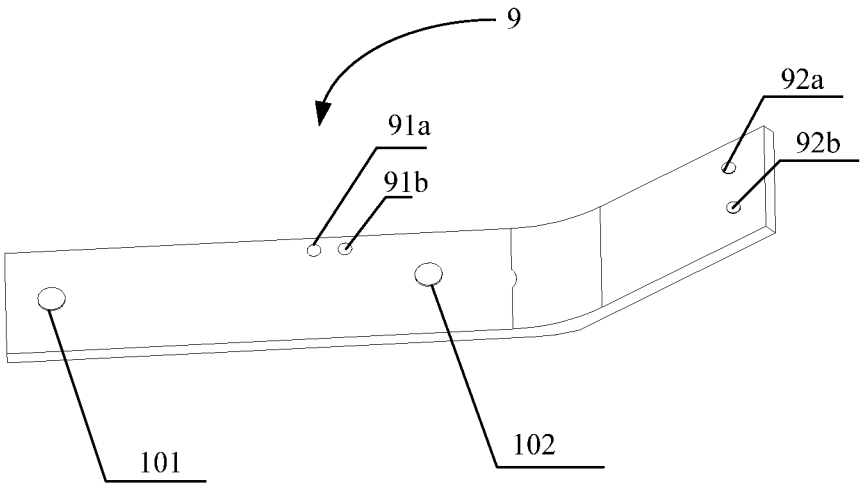
FIG. 15 is a schematic structural view of a circuit board in the ink cartridge provided by embodiment 2 of the present invention.
Figure 18:
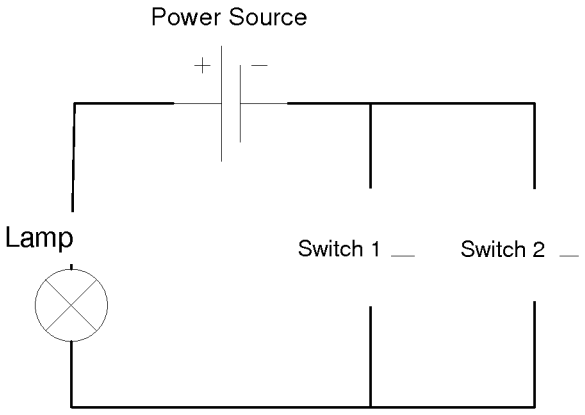
FIG. 18 is a schematic diagram illustrating the working principle of a connecting circuit in the ink cartridge provided by the embodiment 2 of the present invention.

FIG. 15 is a schematic structural view of the circuit board in the ink cartridge provided by the present invention, and FIG. 18 is a schematic diagram illustrating the working principle of the connecting circuit in the ink cartridge provided by the present invention. As illustrated in FIG. 15, the connecting circuit 9 includes first contacts 91*a* and 91*b* (the first contact 91*a* is also referred to as a contact 1 and the first contact 91*b* is also referred to as a contact 2), second contacts 92*a* and 92*b*, a first positioning hole 101 and a second positioning hole 102. As illustrated in FIG. 18, the circuit includes a power source, a lamp, a trigger switch and a circuit switch. The power source is directly disposed on the ink cartridge 1, preferably adopts a direct-current (DC) power supply, e.g., an accumulator, a dry battery and the like, and is directly clamped on the two contacts on the connecting circuit 9 and configured to supply power to the connecting circuit; the trigger switch includes the two first contacts 91*a* and 91*b*; the circuit switch includes the two second contacts 92*a* and 92*b*; the trigger switch and the circuit switch are in series connection; the first contacts 91*a* and 91*b* are switched on when one end of the slider 7 moves thereon, and hence the lamp can emit light; similarly, the second contacts 92*a* and 92*b* are switched on when one end of the lever 12 moves thereon; and thus, the lamp can emit light only when the slider 7 or the lever 12 moves to switch on the trigger switch or the circuit switch on the connecting circuit.

Figure 16:
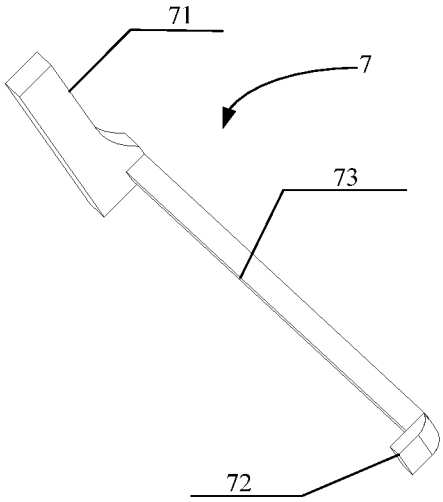
FIG. 16 is a schematic structural view of a slider in the ink cartridge provided by embodiment 2 of the present invention.
Figure 17:
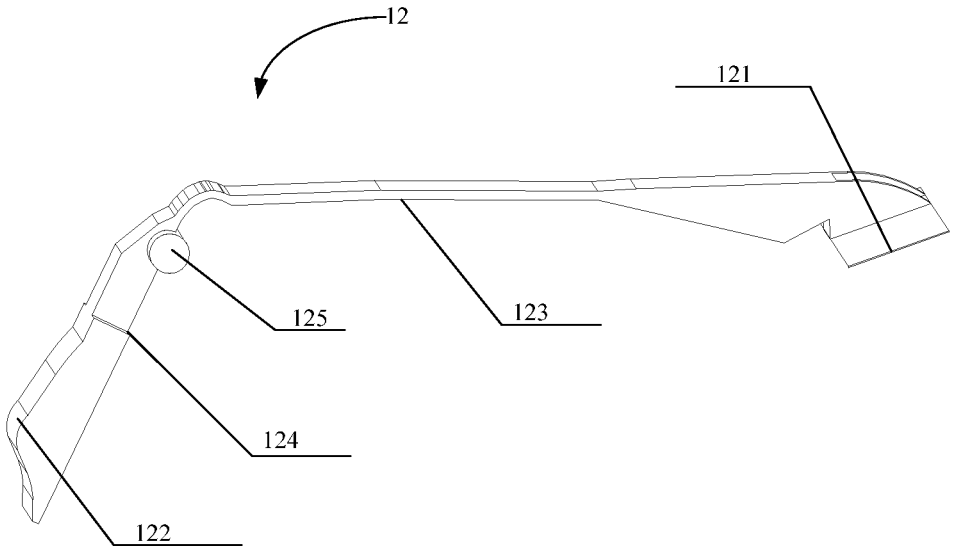
FIG. 17 is a schematic structural view of a lever in the ink cartridge provided by embodiment 2 of the present invention.

FIG. 16 is a schematic structural view of a switch in the ink cartridge provided by the present invention. The slider 7 includes a sliding portion 71, an end portion 72 and a connecting portion 73. The sliding portion 71 is configured to move to and fro in the ink cartridge installation direction along the guide rail 18 in the ink cartridge 1; and the end portion 72 is provided with conductive materials and may switch on the first contacts 91*a* and 91*b* on the connecting circuit 8. FIG. 17 is a schematic structural view of the lever in the ink cartridge provided by the present invention. The lever includes end portions 121 and 122, connecting portions 123 and 124, and a rotating portion 125. The end portion 121 is adhered to an outer surface of the flexible film 25 so that the lever can move along with the movement of the flexible film 25; the rotating portion 125 is coordinated with the recess 151 on the housing 2 so that the lever 12 can rotate around the rotating portion 125; when the end portion 121 moves towards the ink reservoir along with the flexible film 25, the end portion 122 may move in the direction opposite to the moving direction of the end portion 121, namely the end portion 122 moves towards the circuit switch provided with the connecting circuit 9; and as the end portion 122 is provided with the conductive materials, when the ink level in the ink reservoir 4 is less than a default value, the end portion 122 of the lever 12 switches on the circuit switch, and hence the lamp can be switched on and emit light.

Figure 19:
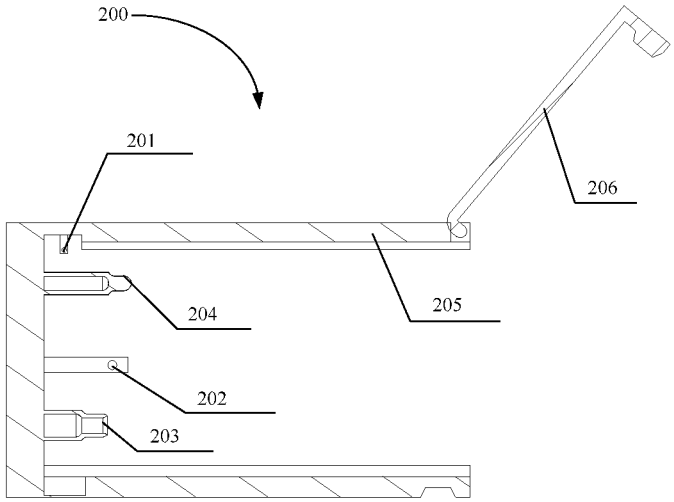
FIG. 19 is a schematic structural view of an ink cartridge installation portion provided by embodiment 2 of the present invention.
Figure 20:
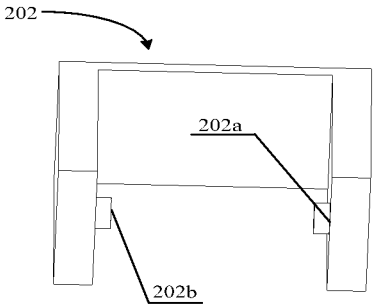
FIG. 20 is a schematic structural view of a sensor in the ink cartridge installation portion provided by the embodiment 2 of the present invention.
Figure 21:
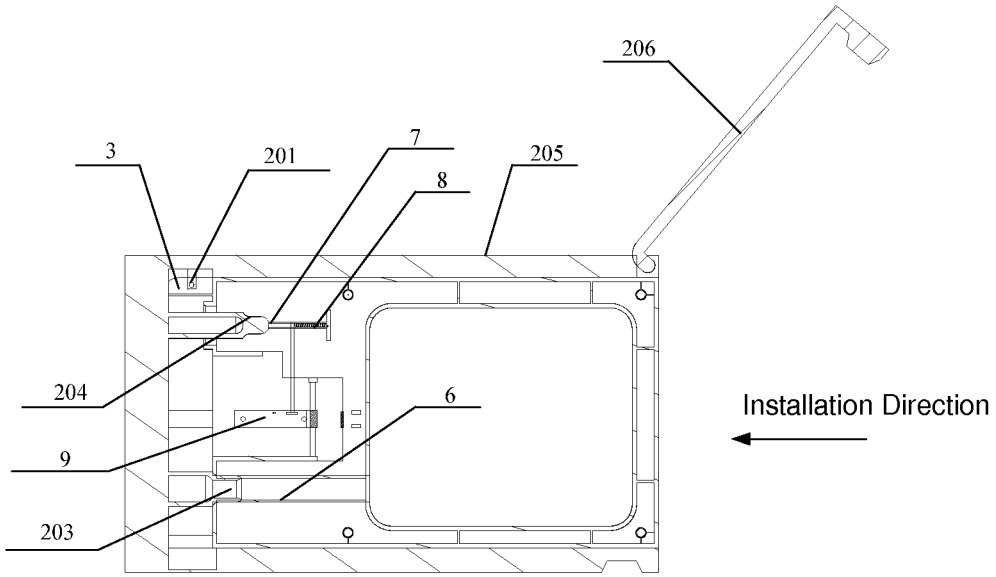
FIG. 21 is a schematic structural view of the ink cartridge provided by the embodiment 2 of the present invention when installed to the ink cartridge installation portion.

The detection of the installation process of the ink cartridge will be described in detail below with reference to FIGS. 11 to 21. FIG. 19 is a schematic structural view of the ink cartridge installation portion of the present invention; FIG. 21 is a schematic structural view of a sensor in the ink cartridge installation portion of the present invention; and FIG. 21 is a schematic structural view of the ink cartridge provided by the present invention when installed to the ink cartridge installation portion. The ink cartridge installation portion 200 includes a first sensor 201, a second sensor 202, an ink supply needle 203, an abutting portion 204, a frame 205 and a cover 206. The first sensor 201 and the second sensor 202 respectively include a light transmitting portion and a light receiving portion; and the light receiving portion may receive light emitted by the light transmitting portion. As illustrated in FIG. 20, the second sensor 202 includes a light transmitting portion 202*a* and a light receiving portion 202*b*; the structure of the second sensor 202 is similar to that of the first sensor 201; when a blocking portion or a reflective member as similar to a prism is disposed between the light transmitting portion 202*a* and the light receiving portion 202*b*, the light receiving portion 202*b* cannot receive the light emitted by the light transmitting portion 202*a*; a control member in the printer determines whether there is a blocking signal or a reflective member is disposed between the first sensor 201 and the second sensor 202 according to optical information fed back by the light receiving portion 202*b*; the first sensor 201 is configured to correspond to the position of the protrusion 3 on the ink cartridge 1; the second sensor 202 is configured to correspond to the position of the connecting circuit 9 on the light shield plate 22 of the ink cartridge 1; the ink supply needle 203 is coordinated with the ink outlet 6 on the ink cartridge 1 and configured to supply the ink in the ink reservoir 4 to a printhead on the printer, and hence the printing process can be completed; and the abutting portion 204 is coordinated with the slider 7 on the ink cartridge.

When the ink cartridge 1 is in the natural state, the slider 7 is disposed on the left of the contact 1, namely 91*a*, in the ink cartridge installation direction under the action of the spring 8; when the ink reservoir 4 is filled with the ink, the end portion 122 of the lever 12 is deviated from the position of the second contact 92*a* or 92*b* under the surface action of the flexible film 25; and at this point, the lamp in the connecting switch 9 is in the off state and cannot emit light. When the ink cartridge 1 is installed to the printer, the light shield plate 22 at the front central end of the ink cartridge blocks a path of light emitted by the light transmitting portion of the second sensor 202 in the printer at first, and hence the protrusion 3 at the front upper end of the ink cartridge blocks a path of light emitted by the light transmitting portion of the first sensor 201 in the printer. Along with the further installation of the ink cartridge 1, the abutting portion 204 abuts against the sliding portion 71 of the slider 7 on the ink cartridge 1. In this case, in the installation process of the ink cartridge 1, the slider 7 will extrude the spring 8, move towards the direction relative to the barrier plate 17, and be more close to the barrier plate 17 until the end portion 72 is disposed on the first contact; at this point, the contact 1, namely 91*a*, and the contact 2, namely 91*b*, will be switched on, and the lamp on the connecting switch 9 will emit light; and hence the light receiving portion 202*b* on the second sensor 202 in the printer will receive light from the ink cartridge. Along with the still further installation of the ink cartridge, in the ink cartridge installation direction, the abutting portion 204 pushes the end portion 72 of the slider 7 on the ink cartridge 1 to the right of the contact 2, namely 91*b*, and the trigger switch is switched off again; at this point, the lamp on the connecting circuit 9 goes out; a preset optical signal will be generated; of course, the preset optical signal may achieve repeated intermittent lumination by the arrangement of several similar switches on the connecting circuit 9; the luminous time can be controlled by the adjustment of the relative distance between the slider 7 and the abutting portion 204; for instance, the equal luminous moment may be earlier than the time when the protrusion 3 blocks the first sensor 201, be the same with the time when the protrusion 3 blocks the first sensor 201 in the printer, or be later than the time when the protrusion 3 blocks the optical transmission path of the first sensor 201; the luminous time can be controlled by the control of the length of the conductive materials on the end portion 72 of the slider 7 and the elasticity of the spring 8; and light with different frequencies, wavelengths and intensities can be obtained by the selection of the lamp. Therefore, the light receiving portions of the sensors on the printer can be guaranteed to be able to receive a reliable optical signal, and hence the problem that the printer cannot continue printing due to the incapability of identification can be avoided. The blocking process of the installation of the ink cartridge may refer to the patent CN102001229.

The remaining ink amount detection component in the ink reservoir 4 may be achieved by the lever 12, the flexible film 25 and the connecting circuit. When the ink cartridge is in the natural state, the end portion 122 of the lever 12 is configured to be deviated from the connecting circuit 9 provided with the circuit switch, and of course, is also deviated from the inner wall 23 of the connecting circuit 9; when the ink level in the ink cartridge is reduced along with printing, one end 121 of the lever 12 adhered to the flexible film 25 moves towards the ink reservoir 4; in this case, the end portion 122 may move towards the inner wall 23 around the rotating portion 125; when the ink level in the ink reservoir 4 is reduced to the default value, the end portion 125 makes contact with the second contact 92*a* or 92*b* of the connecting circuit 9; the circuit switch is switched on by the conductive materials on the end portion 125; at this point, the lamp in the connecting circuit 9 will emit light; the light receiving portion 202*b* of the second sensor 202 may receive the light emitted by the lamp and feed back the light to the printer; the control member of the printer may determine that the ink level in the ink cartridge is less than the default value according to the information and prompt a user to be ready for replacing the ink cartridge. Of course, a speaker may also be arranged to be connected with the connecting circuit so as to generate an alarm signal when the circuit switch is switched on.

In the remaining ink amount detection mode, slight change may also be made. For instance, the two contacts 92*a* and 92*b* of the circuit switch are respectively disposed on the inside of the flexible film 25 and the side of the top cover 13. When the ink level in the ink cartridge is reduced, the contact disposed on the flexible film 25 and the contact disposed on the inside of the top cover 13 are in the on state; and when the ink runs out, the two contacts are in the off state, and the circuit switch is set to be an NC switch, namely the circuit can be switched on only when the two switches are switched off. By adoption of the implementation, the detection mode may be that the contacts are perpendicular to the moving direction of the ink reservoir, and the lever is not required. All the implementations should fall within the scope of protection of the present invention.

Embodiment 3

Figure 22:
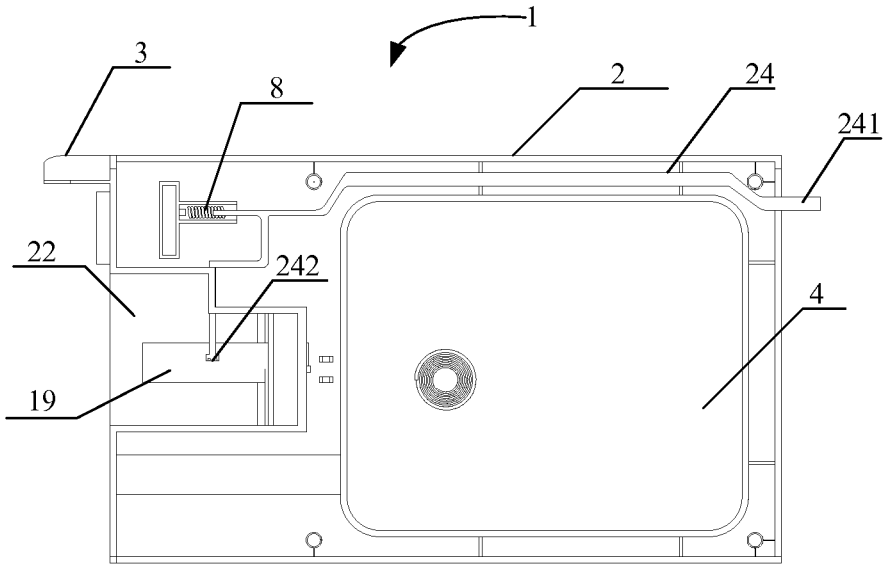
FIG. 22 is a schematic structural view of an ink cartridge provided by an embodiment 3 of the present invention.
Figure 23:
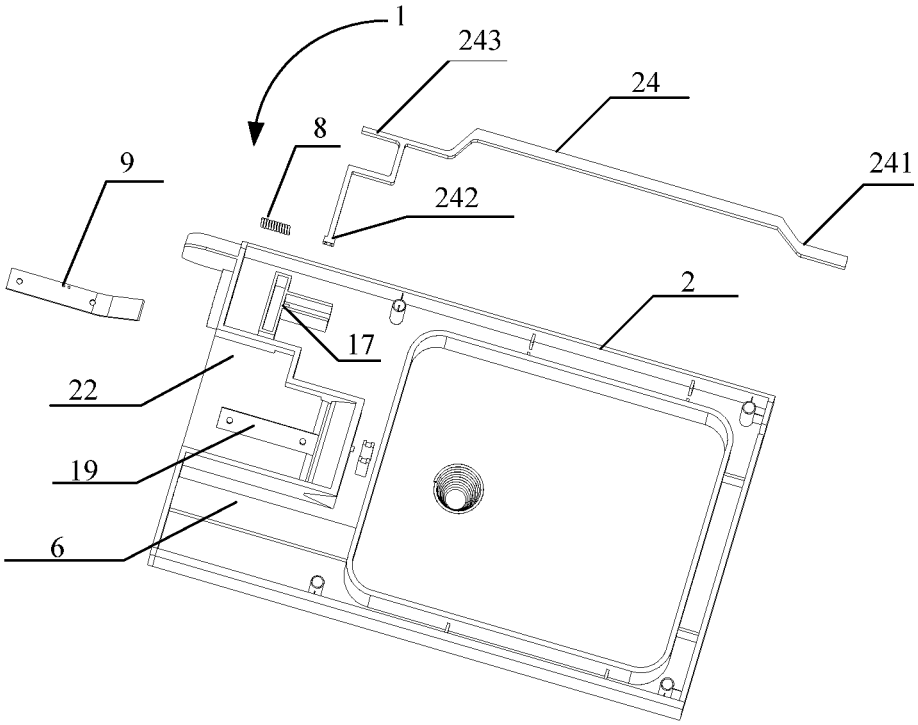
FIG. 23 is a schematic exploded view of the ink cartridge provided by the embodiment 3 of the present invention.
Figure 24A:
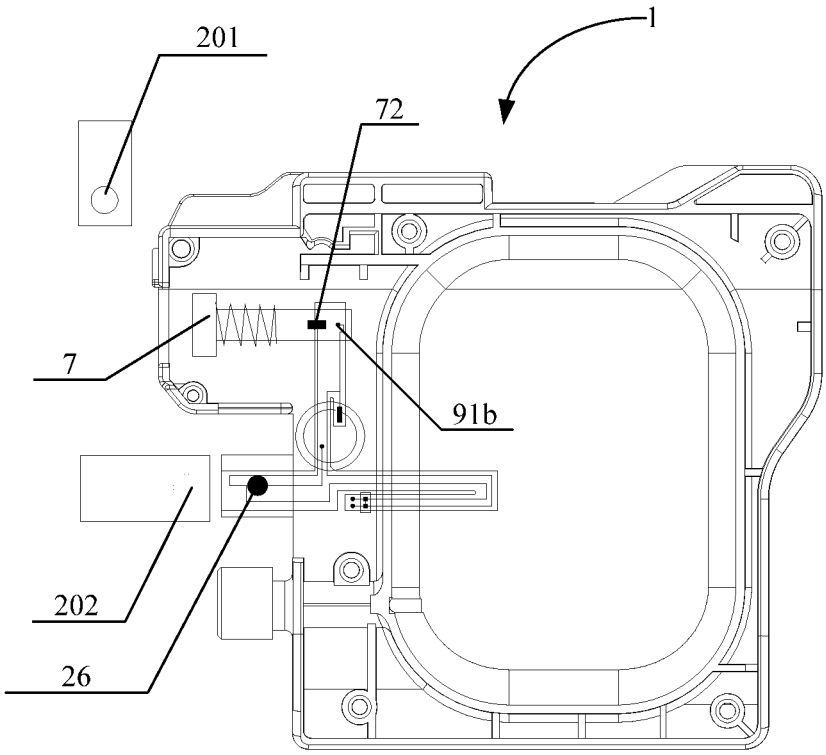
FIGS. 24(*a*) to 24(*e*) are schematic diagrams illustrating the installation process of an ink cartridge provided by an embodiment 4 of the present invention.
Figure 24B:
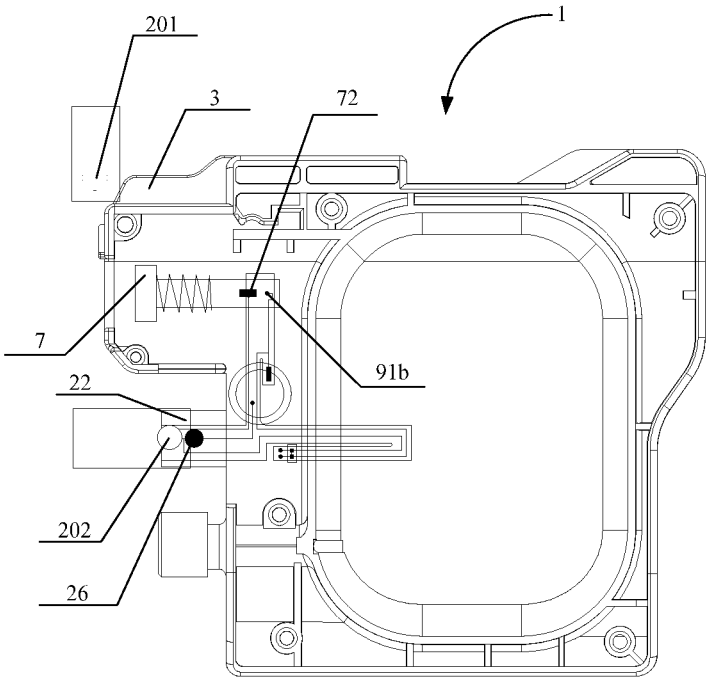
Figure 24C:
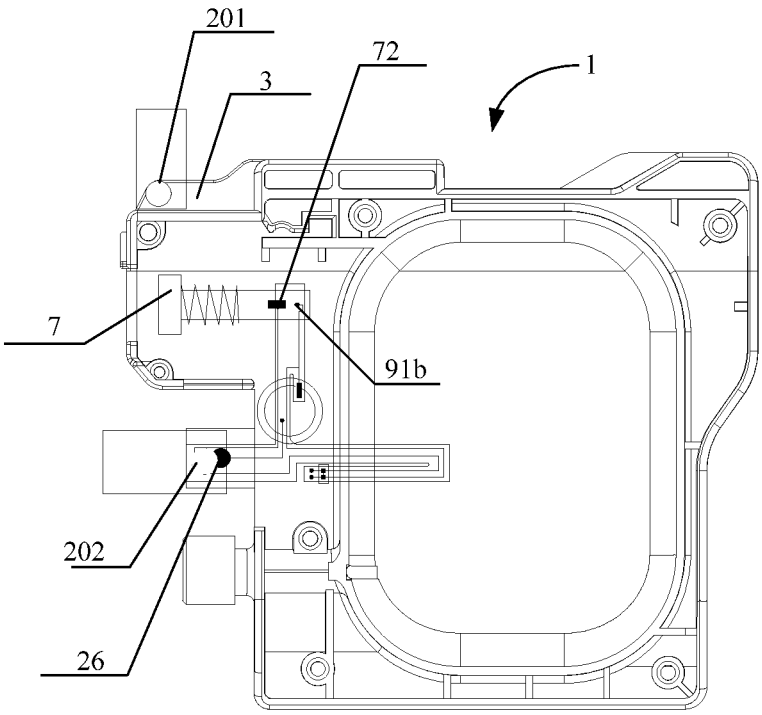
Figure 24D:
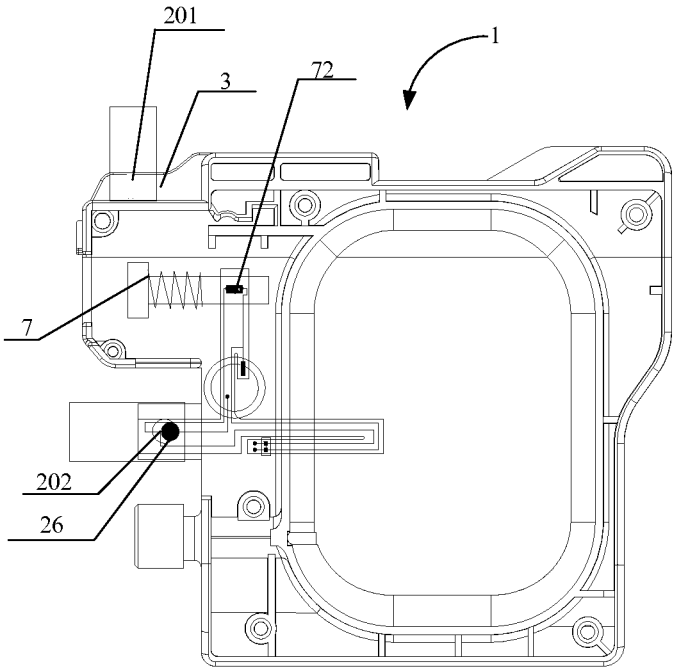
Figure 24E:
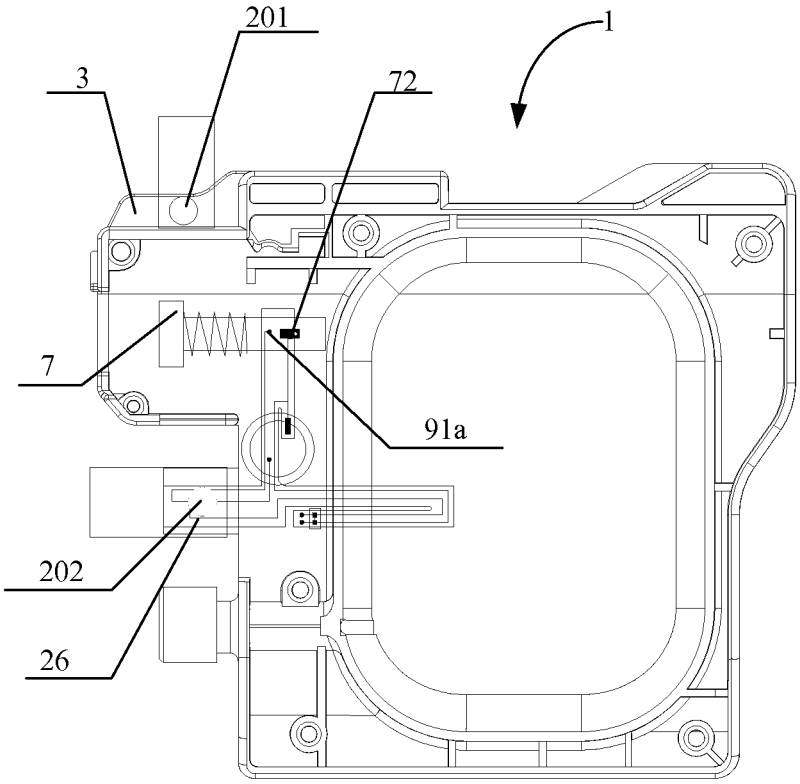

The sequence of the ink cartridge blocking the printer in the embodiment is similar to that of the embodiment 2. The difference is that one end of the trigger switch is disposed at the rear of the ink cartridge so that the trigger switch can be controlled by manual operation in the installation process of the ink cartridge. The function of the slider 7 in the embodiment 2 is achieved by a handle 24 in the embodiment. FIG. 22 is a schematic structural view of the ink cartridge provided by the present invention, and FIG. 23 is a schematic exploded view of the ink cartridge provided by the present invention. As illustrated in FIG. 23, one end 241 of the handle is disposed at the rear end of the ink cartridge; an end portion 243 opposite to the end portion 241 is still coordinated with the spring 8; relative positions of the barrier plate and the guide rail are exchanged relative to the ink cartridge provided by the embodiment 2; the barrier plate is disposed at the front end of the guide rail in the installation direction; the handle 24 is also provided with an extended end portion 242 which is provided with conductive materials and may switch on the trigger switch in the connecting circuit; the handle 24 may slide along the ink cartridge installation direction; in this case, in the installation process of the ink cartridge, the handle 24 may be pushed by a hand to switch on the trigger switch in the connecting circuit 9; the luminous time and the luminous moment of the lamp in the connecting circuit 9 may be controlled by the time and moment of manual pushing; after the manual release, the spring 8 pushes the handle 24 to an initial position; and at this point, the lamp goes out again, and a preset signal is generated. In a preferred embodiment, a cover 206 of the printer is adopted to push the handle; at first, the end portion 242 is pushed to a position at which the end portion 242 switches on the trigger switch; and hence the end portion 242 of the handle 24 is pushed to a position deviated from the trigger switch.

Embodiment 4

FIGS. 24(*a*) to 24(*e*) are schematic diagrams illustrating the installation process of an ink cartridge provided by the embodiment 4 of the present invention. The difference between the ink cartridge in the embodiment and that in the embodiment 1 is that: the light-emitting portion 26 and the light-emitting member in the embodiment are same component, namely the same light-emitting portion 26 is adopted in both the installation detection process and the remaining ink amount prompt process of the ink cartridge. Preferably, the light-emitting portion is a light-emitting diode (LED) lamp. As illustrated in FIG. 24(*a*), the ink cartridge 1 is in the first state, namely the ink cartridge 1 is just installed; at this point, the optical transmission paths of the first sensor 201 and the second sensor 202 are not changed, namely the light receiving portions of the sensors may receive light emitted by the light-emitting portions of the sensors. As illustrated in FIG. 24(*b*) which is a schematic diagram of the ink cartridge 1 in the second state, the light of the second sensor 202 is blocked by the light shield plate 22 disposed at the front central end of the ink cartridge at first; at this point, the light receiving portion of the second sensor cannot receive the light emitted by the light-emitting portion of the second sensor and the state of the first sensor is not changed. As illustrated in FIG. 24(*c*) which is a schematic diagram of the ink cartridge 1 in the third state, the light emitted by the second sensor 202 is still blocked by the light shield plate 22 on the ink cartridge and the light emitted by the first sensor 201 is also blocked by the protrusion 3 at the front end, namely the light receiving portion of the first sensor 201 cannot receive the light emitted by the light-emitting portion of the first sensor 201. As illustrated in FIG. 24(*d*) which is a schematic diagram of the ink cartridge 1 in the fourth state, along with the installation of the ink cartridge 1, the slider 7 abuts against the printer and moves back relative to a front end surface of the ink cartridge; at this point, the end portion 72 on the slider 7 moves from the initial position on the right of the first contact 91*b* to the position on the first contact 91*a* or 91*c* on the connecting circuit 9; the conductive sheet on the end portion 72 may switch on the trigger switch; of course, the end portion 72 may be subjected to direct injection molding of the conductive materials; and in this case, when the ink cartridge 1 is in the fourth state, the light-emitting portion 26 can emit light to the light receiving portion of the second sensor 202 on the printer. As illustrated in FIG. 24(*e*) which is a schematic structural view of the ink cartridge 1 in the fifth state, along with the further installation of the ink cartridge 1, the slider 7 abuts against the abutting portion of the printer and further moves to the position deviated from the first contact 91*a* and close to the second contact 91*b* relative to the front end surface of the ink cartridge; at this point, the end portion 72 cannot switch on the first contacts 91*a* and 91*b*, and the light-emitting portion 26 cannot emit light; and both the optical transmission paths of the first sensor 201 and the second sensor 202 are changed. In the installation process of the ink cartridge, the light receiving portion of the first sensor 201 and the light receiving portion of the second sensor 202 feed back the above information to the control member of the printer; and the control member of the printer compares the detected information with the preset information and determines that the ink cartridge is a correct ink cartridge when the light shield moment and sequence are the same with the preset information.

Of course, the connecting circuit 9 may also be connected with a control module. The control module is provided with a preset program. In this case, after the ink cartridge is installed to the printer, the luminous process is automatically produced. Or a starting switch is disposed on the outside of the housing of the ink cartridge and configured to start a luminous program in the control module, so that the control process can be more intelligent.

Of course, the embodiments of the present invention are not limited thereto. All the modifications made to the technical proposals by those skilled in the art without creative labor should fall within the scope of protection of the present invention. For instance, the slider 7 or the handle 24 is set to be able to rotate around a rotating shaft and not slide along the ink cartridge installation direction; the number and the position of the sensors are set to be different; various components in the connecting circuit are subjected to conductive connection; and in the case of the automatic arrangement of the sensors on the printer, electrical and magnetic signals and the like can be produced according to the type of the sensors. All the above technical proposals should fall within the scope of protection of the present invention.

What is claimed is:

1. An ink cartridge for an inkjet printer, the inkjet printer comprising a first sensor which comprises a first light transmitting portion and a first light receiving portion, and a second sensor which comprises a second light transmitting portion and a second light receiving portion, the ink cartridge, comprising:

an ink reservoir for storing ink, an ink outlet for supplying ink to the printer, and an installation detection component coordinated with the printer to detect whether the ink cartridge is successfully installed, the installation detection component including:

a first signal blocking portion disposed at the front upper end of the ink cartridge and a second signal blocking portion disposed on a light shield plate at the front central end of the ink cartridge, wherein the first signal blocking portion can block light from the first light transmitting portion and the second signal blocking portion can block light from the second light transmitting portion, a controller, a connecting circuit, and a light-emitting portion disposed on the light shield plate of the ink cartridge and connected with the controller through the connecting circuit, wherein the controller is configured to control the light-emitting portion, after the second signal blocking portion blocks light from the second light transmitting portion, to emit light, the light emitted by the light-emitting portion is then received by the second light receiving portion, to determine whether the installation is successful, and wherein the controller controls the light-emitting portion automatically.

2. The ink cartridge for the inkjet printer according to claim 1, wherein the controller is a trigger switch which comprises a slider sliding in the installation process of the ink cartridge to control the light emission of the light-emitting portion.

3. The ink cartridge for the inkjet printer according to claim 1, wherein the controller is an automatic control module which automatically controls the light emission of the light-emitting portion.

4. The ink cartridge for the inkjet printer according to claim 1, wherein the installation detection component further includes a battery which supplies power to the controller and the light-emitting portion through the connecting circuit.

5. The ink cartridge for the inkjet printer according to claim 1, wherein the installation detection component further includes a first signal blocking portion disposed at the front upper end of the ink cartridge and a second signal blocking portion disposed at the front central end of the ink cartridge; the second signal blocking portion is disposed on a light shield plate of the ink cartridge; and the light-emitting portion is also disposed on the light shield plate.

6. The ink cartridge for the inkjet printer according to claim 2, further comprising a reset member which is coordinated with the trigger switch in such a way that the trigger switch is restored to a natural state when the ink cartridge is not installed.

7. The ink cartridge for the inkjet printer according to claim 3, wherein the automatic control module is configured to control the light emission of the light-emitting portion according to the detection requirement of successful installation in the installation detection program of the printer.

8. The ink cartridge for the inkjet printer according to claim 1, wherein the light emitted by the light-emitting portion is visible light or infrared light.

9. The ink cartridge for the inkjet printer according to claim 6, wherein one end of the trigger switch is disposed on the front of the ink cartridge so that the trigger switch can abut against an inner wall of the printer in the installation process of the ink cartridge.

10. The ink cartridge for the inkjet printer according to claim 6, wherein one end of the trigger switch is disposed at the rear of the ink cartridge so that the trigger switch can be controlled by manual operation in the installation process of the ink cartridge.

11. The ink cartridge for the inkjet printer according to claim 1, further comprising an remaining ink amount detection component, the remaining ink amount detection component including a control mechanism relevant to the remaining ink amount in the ink reservoir and an alarm mechanism connected with the control mechanism and configured to generate an alarm signal when the remaining ink amount in the ink reservoir is less than a default value, at least one side wall of the ink reservoir formed by a deformable film, wherein the control mechanism is a circuit switch; the on-off state of the circuit switch is controlled by the moving distance of the deformable film; and whether the alarm mechanism generates the alarm signal or not is controlled by the on-off state of the circuit switch.

12. The ink cartridge for the inkjet printer according to claim 11, wherein the circuit switch is a slide switch which is switched on or off by sliding driven by the movement of the deformable film.

13. The ink cartridge for the inkjet printer according to claim 11, wherein the circuit switch is a contact switch which is switched on or off by contact separation or touch driven by the movement of the deformable film.

14. The ink cartridge for the inkjet printer according to claim 12, wherein the alarm mechanism is a light-emitting member or a speaker.

15. The ink cartridge for the inkjet printer according to claim 13, wherein the alarm mechanism is a light-emitting member or a speaker.

16. The ink cartridge for the inkjet printer according to claim 1, wherein the controller is configured to control the light-emitting portion not to emit light when the ink cartridge is completely installed to the printer.

* * * * *